United States Patent [19]

Stenson

[11] Patent Number: 4,954,011

[45] Date of Patent: Sep. 4, 1990

[54] POWERED METHOD AND APPARATUS FOR LIFTING A BOAT

[76] Inventor: Samuel H. Stenson, HCR 77, Pine River, Minn. 56474

[21] Appl. No.: 226,800

[22] Filed: Aug. 1, 1988

[51] Int. Cl.[5] ..... B63C 3/08

[52] U.S. Cl. ..... 405/3; 405/221; 114/48; 187/8.59; 439/504

[58] Field of Search ..... 405/3, 221; 114/44, 114/45, 48; 439/490, 502, 503, 504; 187/8.59

[56] References Cited

U.S. PATENT DOCUMENTS

| | | | |
|---|---|---|---|
| Re. 32,118 | 4/1986 | Godbersen | 414/680 X |
| 2,934,220 | 4/1960 | Murphy . | |
| 3,012,757 | 12/1961 | Marzolf . | |
| 3,077,742 | 2/1963 | Brown . | |
| 3,169,644 | 2/1965 | Godbersen | 405/221 X |
| 3,177,668 | 4/1965 | Schneider et al. . | |
| 3,275,167 | 9/1966 | Godbersen . | |
| 3,697,048 | 10/1972 | Sarno | 254/148 |
| 3,967,570 | 7/1976 | Bradfield | 114/45 |
| 4,318,632 | 3/1982 | Fortmeyer | 405/3 |
| 4,336,975 | 6/1982 | Casteel | 439/503 |
| 4,726,786 | 2/1988 | Hill | 439/504 |

OTHER PUBLICATIONS

"Shore Line Lift Motor" advertisement, Shaveline Services Inc., Pine River, MN 56474.

"Shore Station Boat Hoists '88", advertisement, Shore-Station Marine Division, Ida Grove, Iowa 51445.

*Primary Examiner*—Randolph A. Reese

*Assistant Examiner*—Arlen L. Olsen

*Attorney, Agent, or Firm*—Henry C. Kovar

[57] ABSTRACT

A powered method and apparatus for raising and lowering a boat in a boat lift with quick connection to and use of the boat battery to power a DC electric motor on the lift. A method of converting a manual lift to a powered lift is provided. The lift drive has a tractive drive unit with a friction wheel and the motor and a reduction drive, a drive unit subframe, a drive unit mount adjustable on the frame of the lift, adjustment structure to locate the subframe in a desired position in any one of a variety of boat lifts and with respect to a variety of manually operable lift actuator wheels, structure to resiliently bias the friction wheel against the actuator wheel, structure to stably remove the friction wheel from the actuator wheel, a quick connector for connection to a boat battery, and a switch for selective control of motor operation and direction of rotation.

21 Claims, 2 Drawing Sheets

POWERED METHOD AND APPARATUS FOR LIFTING A BOAT

BACKGROUND OF THE INVENTION

1. Field of the Invention:

This invention pertains to a powered method of and apparatus for lifting a boat.

2. The Prior Art

Boat lifts for runabouts, ski boats, fishing boats, pontoon boats and most boats of trailerable size are quite well known and extensively used. These boat lifts are available from several sources and have several types of mechanical mechanisms to raise a boat.

A typical boat lift has a frame with four upright corner posts and a vertically movable platform or pair of cross beams suspended by the frame. A manual crank mechanism is provided to raise and lower the platform while the boat is on the platform.

Boats keep getting bigger and better with I/O motor/drives becoming more and more popular. These boats are valuable and need to be stored in a boat lift. These boats are trending bigger and heavier and the population of boat users is getting older. The effort required to manually raise boat lifts is becoming relatively greater and, in many cases, too much. The effort required to operate many boat lifts is beyond the physical capabilities of kids, women, handicapped and seniors.

A typical prior art and extensively commercialized boat lift is shown in B. L. Godbersen's U.S. Pat. Re. No. 32,118. As this patent shows, a typical boat lift is manually powered by rotation of a large wheel, in the range of three to four feet in diameter. This is typical of the vast majority of boat lifts.

An electric power drive is commercially available for the Godbersen boat lift. This drive has an 115VAC electric motor connected through a gearbox to an elastomeric traction drive wheel. This drive mounts on the Godbersen lift adjacent the bottom of the actuation wheel and frictionally engages and drives the wheel. This device is dedicated to and operative only with Godbersen boat lifts. This particular lift drive has a "dead-man" driving connection and must manually be held against the lift actuator wheel. This device will raise the lift only and will not lower the lift. The lift must be manually lowered. 115VAC power on or near the motor and out on the dock is dangerous stuff. It also requires power lines from an on-shore power source.

OBJECTS OF THE INVENTION

It is an object of this invention to provide an improved powered method of and apparatus for lifting a boat.

It is an object of this invention to provide an improved method of and apparatus for converting a manual boat lift into a powered boat lift.

It is an object of this invention to provide an improved and relatively safe and low cost power boat lift drive mechanism that is relatively easy to install and use.

SUMMARY OF THE INVENTION

An electrically powerable boat lift assembly has a mechanical boat lift with a frame, lift structure, lift drive movement, lever to operate the movement, a tractive drive unit with a friction wheel and DC motor, a mount movably mounting the drive unit on the lift frame, biasing means resiliently biasing the friction wheel against the lever, a connector for electrically connecting the motor to a boat battery, and an electrical switch for selective control of motor and wheel rotation and direction of rotation.

In a boat lift assembly having a manual actuator wheel of at least two feet in diameter, the improvement of an electric boat lift actuator wheel drive having a tractive drive unit with a friction wheel and a DC motor, a drive unit subframe, a drive unit mount movably mounting the subframe and drive unit to a lift frame, biasing structure resiliently biasing the friction wheel against the actuator wheel, an electrical connector for connecting the motor to a boat battery, and a switch for selectively controlling motor operation and direction of rotation.

An electric boat lift device for a mechanical boat lift has a tractive drive with a DC motor and a friction wheel, a drive unit subframe, a drive unit mount with structure to be fastened to a lift frame and structure for movable support of the subframe, adjustment structure in the mount for adjusting the position of the drive unit and subframe with respect to an actuator wheel of the lift, a quick electrical connector for connection of the motor to a boat battery, and a directional control switch for control of the motor.

A method of electrically raising and lowering a boat in a boat lift has the steps of floating a boat with a battery into a lift, connecting the boat battery to an electric motor mounted on the lift, running the motor and a tractive wheel in respective first directions, biasing the tractive wheel against an actuator wheel of the lift, frictionally driving the actuator wheel in a respective first direction to raise and lift the boat, stopping the motor, switching polarity of the battery to motor connection, and reversing the rotation of the motor and both wheels to lower the boat, disconnecting the boat battery from the motor, and removing the boat from the lift.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

Figure 1:
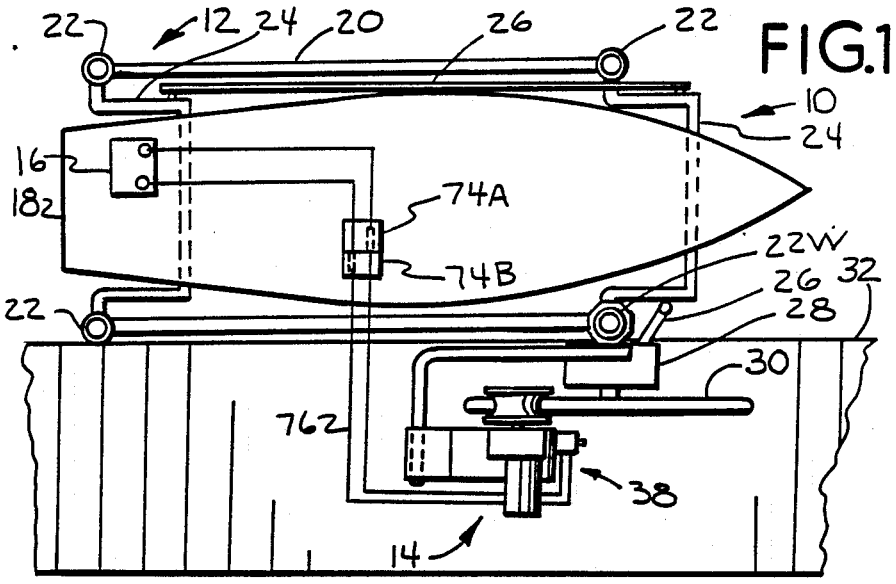
FIG. 1 is a top plan view of the improved powered boat lift of the present invention.

DESCRIPTION OF THE PREFERRED EMBODIMENT:

According to the principles of the present invention, an electrically powerable boat lift assembly is provided as shown in FIG. 1 and as generally indicated by the numeral 10. The entire lift assembly 10 includes a discrete and normally manually operable mechanical boat lift such as the type shown in any of the following U.S. Pat. Nos.

| | | |
|---|---|---|
| 2,934,220 | D. M. Murphy | 4/60 |
| 3,012,757 | G. Marzolf | 12/61 |
| 3,077,742 | P. Brown | 2/63 |
| 3,169,644 | B. L. Godbersen | 2/65 |
| 3,177,668 | D. J. Schneider | 4/65 |
| 3,275,167 | B. L. Godbersen | 9/66 |
| 3,697,048 | R. L. Sarno | 10/72 |
| Re 32,118 | B. L. Godbersen | 8/83 |

A new electric boat lift drive is generally indicated by the numeral 14, and utilizes the battery 16 which is normally the battery 16 of the boat 18 to be raised, stored and lowered in the lift assembly 10.

Figure 3:
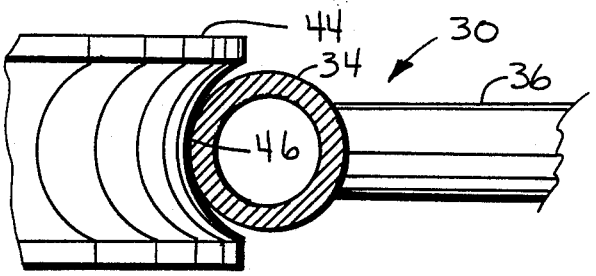
FIG. 3 is a cross sectional view of the tractive drive of the lift of FIG. 1.

The mechanical lift 12 is conventional and well known and may be a new unit or an existing old unit to be upgraded with, by and into the present invention. The lift 12 has a frame 20 with a plurality of vertical and relatively fixed posts 22. A lifting structure 24, which may be a cradle, sling, turn up arms, arrangement of cables or other contrivance, is movably mounted on and supported by the frame. A lifting or drive mechanism 26 is mounted on the lift 12 and is operative between the relatively fixed frame 20 and the relatively movable lifting structure 24. The lifting drive mechanism 26 usually includes a gearbox 28 and a plurality of cables, push-pull rods or gears and shafts. The lifting drive mechanism 26 is provided with a manually operable actuator wheel 30 which is almost always rotatable about a horizontal axis and which is rotatably mounted in an axis fixed with respect to the frame 20. The actuator wheel 30 is a closed loop curved lever, and is almost always of at least two feet in diameter. Some actuator wheels 30 are four feet in diameter and even larger to provide sufficient leverage for manual operation of the boat lift 12 from the adjacent dock 32. The actuator wheel 30 has a circular outer ring 34 that is almost always a circularly formed and closed round hollow tube 34 as seen in FIG. 3 and which is connected to the gearbox 28 by a plurality of spokes 36.

Figure 2:
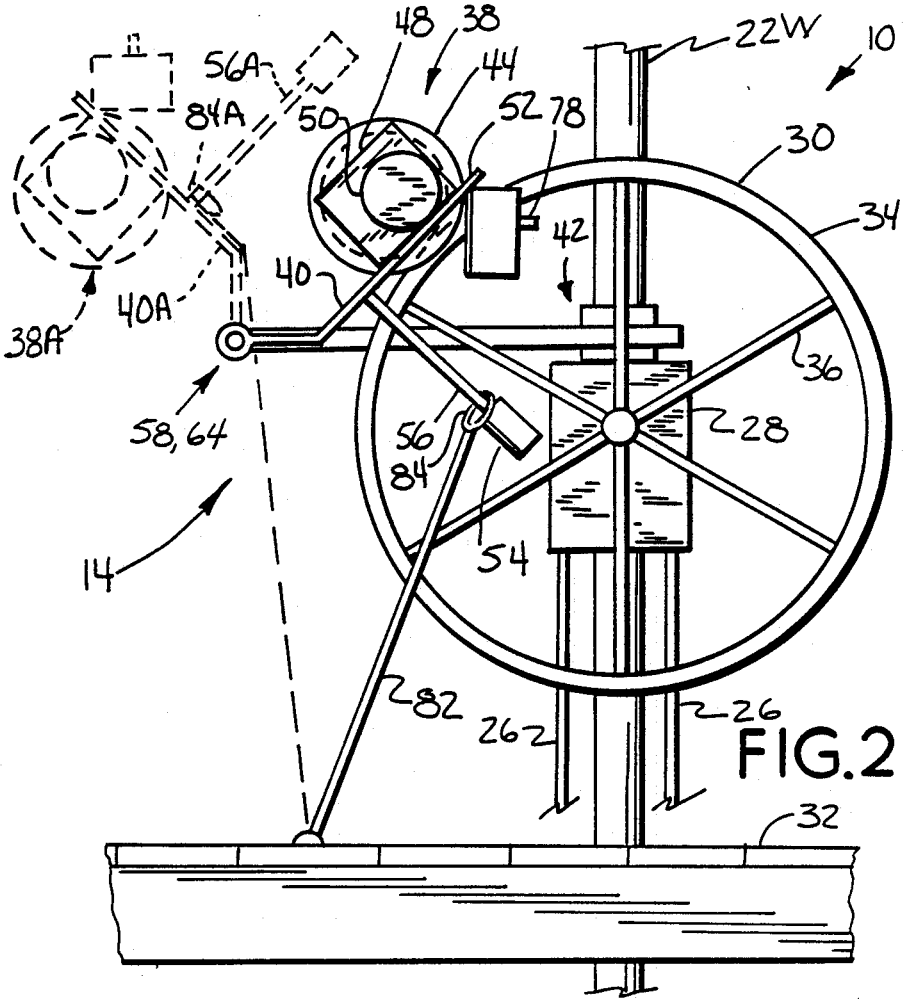
FIG. 2 is an elevational side view of the electric lift drive of FIG. 1.

An important part of this invention is the electric boat lift drive 14 seen from the top in FIG. 1 and shown in greater detail from the side in FIG. 2. The lift drive 14 includes a tractive drive unit generally indicated by the numeral 38 which is mounted on a subframe 40 which is in turn movably mounted upon a drive unit mount generally indicated by the numeral 42. The drive unit 38 includes a tractive friction drive wheel 44 having a concave track 46 for optimizing frictional engagement with and against the wheel ring 34. The track 46 is preferrably a high friction and low wear elastomeric or similar material. The wheel 44 is operatively connected to the slow side output of a reduction drive 48 which is driven by a DC motor 50, preferrably of the permanent magnet type. The motor 50 and reduction drive 48 are preferrably an in-line generally co-axial integral motor gearbox unit with the friction drive wheel 44 being on the outboard end of the gearbox and generally in line with the motor 50 and gearbox drive 48. The reduction drive 48 may have spur gears, a harmonic drive, a planetary geartrain and need not have a self locking worm gear and need not have a discrete brake. The subframe 40 has on its outboard end a motor mount 52 to which the drive unit 38 is fixedly mounted. The inboard end of the subframe 40 has a structure generally indicated by the numeral 58 for movable, and preferrably rotatable mounting of the subframe 40 and drive unit 38 to the drive unit mount 52 for purposes to be explained. A tending handle 54 is secured to the subframe 40 by a skewed lever 56.

Figure 5:
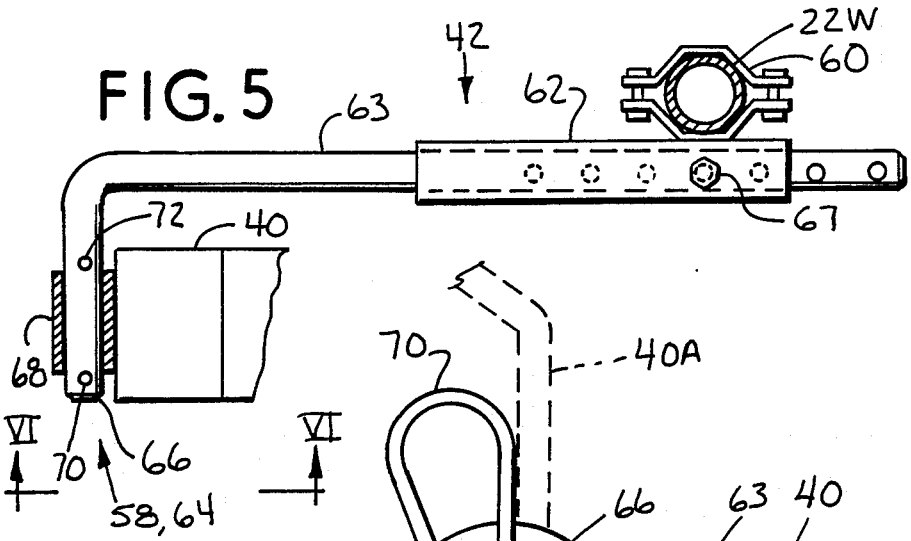
FIG. 5 is a top plan view of the drive unit support in the lift of FIG. 1.
Figure 6:
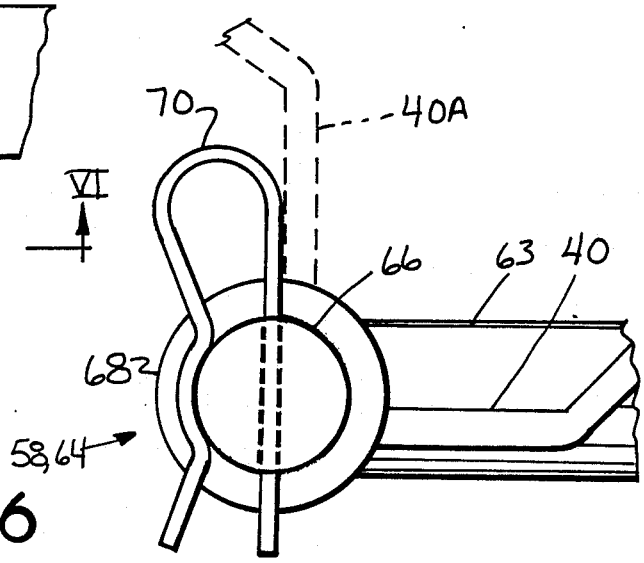
FIG. 6 is a side elevational view along lines VI—VI of FIG. 5.

The drive unit mount 42 as best shown in detail in FIG. 5, is preferrably mounted to the same frame post 22W that the actuator wheel 30 is mounted to. The unit mount 42 has structure on one end for securing the mount 42 to the lift frame 20; the preferred mount securing structure shown is a saddle clamp 60 which will fit on any one of a variety of different sized frame posts 22. An elongate tube 62 is secured to the saddle clamp 60 and serves as a pilot for an elongate inner mount rod 63 which extends outward to a support structure generally indicated by the numeral 64 to which the subframe 40 and drive unit 38 can be movably mounted; the preferred support structure 64 shown is an elongate round shaft 66. The position of the shaft 66 with respect to the saddle clamps 60 is adjustable to a desired position by one of a multiple hole and cross bolt construction 67 enabling about six adjustments of about two inches each. This quantity of adjustment is sufficient for variance of at least two feet in the diameters of various actuator wheels 30 as will be described. The preferred movable mount structure 58 on the subframe 40 is hub 68 formed by an elongate length of metal tube having an inner diameter slip fitted on the shaft 66. The hub 68 is retained on the shaft 66 by a semi-permanent clevis pin 70, and preferrably a second and inner clevis pin 72. The two clevis pins 70, 72 are preferrably aligned with each other and serve a second function to limit relative movement of the subframe 60 as will be explained.

Figure 4:
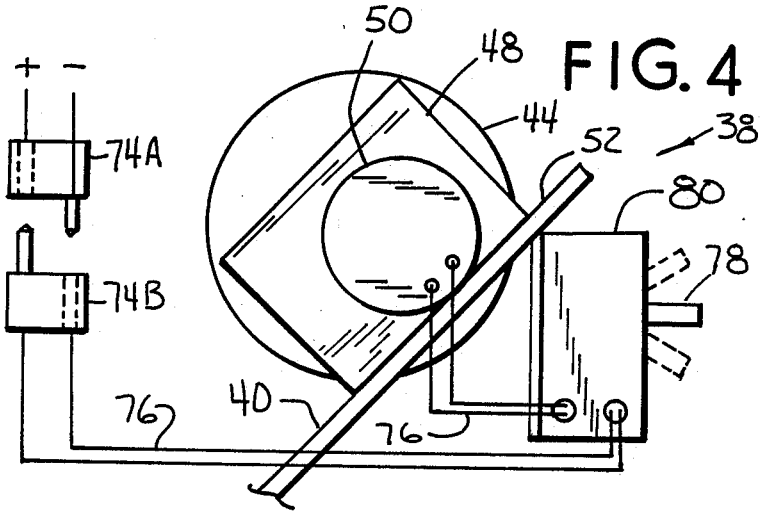
FIG. 4 is an elevational side view of the electric lift drive showing the electrical connections.

The electrical componentry of the lift assembly 10 and drive unit 38 are best shown in FIGS. 1 and 4. The boat battery 16 is provided with a power cable and an accessible one half of a polarized electrical quick connector 74A. An electrical cord 76 leads from the motor 50 to the second half of the polarized connector 74B. A motor control switch 78 is disposed in the cord 76. The switch 78 flips one way (i.e. up) to cause the motor 50 and drive wheel 44 and actuator wheel 30 a respective first direction to raise the lifting structure 74 and the boat 18. The switch 78 flips a second way (i.e. down) to change the polarity of the electrical connection and cause the motor 50, drive wheel 44 and actuator wheel 30 to go a respective second direction to lower the lifting structure 24 and boat 18. The switch 78 is preferrably what is generically referred to as a positive center stop switch which must stop at the center "off" position and cannot be thrown from "up" to "down" or vice-versa. The switch 78 is preferrably mounted in a waterproof switchbox 80 secured to the subframe 40 adjacent the drive unit 38.

Referring back to FIG. 2, a bungee cord or tension cord or tension spring 82 is preferrably fastened between the lever 56 and either the lift frame 20 or the dock 32 in a geometric relationship generally as shown. The cord 82 is connected by a slidable slip ring 84 on the lever 56 and when the friction wheel 44 is against the actuator wheel 30 as shown, the lever 56 is skewed at an obtuse angle from the cord 82 so that the ring 84 slides out on the lever 56 to an outboard position adjacent the handle 54. The drive wheel 44 is preferrably located above the horizontal centerline of the actuator wheel 30 to one side of the vertical centerline of the actuator wheel 30; specifically it is located in either the upper first or second quadrant as defined by the actuator wheel 30 as seen in FIG. 2. The drive mount structure 58 and support structure are likewise located and are preferrably below the level of the drive wheel 44 and farther from the actuator wheel 30 than the drive wheel 44.

In the use and operation of the powered boat lift assembly 10 and the lift drive 14, and in the practice of the methods of the present invention, the lift drive 14 is firstly installed upon a new boat lift 12 or an older existing manual boat lift 12 to convert it from manual to powered. The saddle clamp 60 is loosely attached to the frame post 22W having the actuator wheel 30 and the unit mount 42 is moved on the post 22W by sliding the loose saddle clamp 60 until the entire unit mount 42 is in an appropriate and desired position with respect to the actuator wheel 30 in a first direction, i.e. the Y-axis. The saddle clamp 60 is then completely tightened to fix the mount 42 with respect to the frame 20. The rod 63 is then extended in or out in the tube 62 to position the shaft 64 in a desired and proper position with respect to the actuator wheel 30 in a second direction generally normal to the first direction, i.e. in the X-axis. The bolt structure 67 is then secured to fix the shaft 66 in position. The second pin 72 is placed in the shaft 66 and the hub 68 is slipped onto the shaft 66 bringing the subframe 40 and drive unit 38 into engagement as shown in FIG. 2. The retainer pin 70 is then installed. The bungee cord 82 is connected and the battery connector 74 installed in the boat. The complete powered boat lift 10 is now ready to operate.

In the operation of the powered lift 10, the boat 18 is floated into the lift 10 for operative convention with the lifting structure 24. The motor 50 is connected to the boat battery 16 with the quick connector 74A, B. the switch 78 is thrown up and the motor 50 started. The revolving drive wheel 44 fictionally drives the manual actuator wheel 30 and raises the lifting structure 24 and boat 18 to a desired position whereupon the switch 76 is either automatically or manually turned off. The battery 16 may then be disconnected or left connected as is appropriate. When the boat 18 is to be used again, the switch 78 is thrown down and the motor 50 is started and the drive wheel 44 frictionally drives the actuator wheel 30 the other direction and lowers the lifting structure 24 and lowers the boat 18 back into the water. The connector 74A, B, is then disconnected and the boat 18 is taken out of the powered lift 10. During operation of the drive unit 38 the friction wheel 44 is resiliently biased against the actuator wheel 30 firstly by the geometry of the lift drive 14 which places the drive wheel 44, motor 50 and gearbox 28 between the actuator wheel 30 axis and the pivotal suspension at structures 58, 64, as measured along the X-axis. The friction wheel 44, motor 50 and gearbox 48 also are above the support structures 58, 64, and tend to press downwardly about the shaft 66 onto the actuator wheel 30. The friction wheel 44 is secondly and further resiliently biased against the actuator wheel 30 by the cord 82 pulling on the outboard end of the lever 56.

The powered lift 10 can still be manually operated, either without the boat 18 and the battery 16, or with a boat 18 and no battery. The handle 54 and lever 56 are manually pushed up to pick the friction wheel 44 up and off of the actuator wheel and the entire subframe 40 and drive unit 38 are rotated (CCW in FIG. 2) outwards over the support structure 58, 64 until the weight of the friction wheel 44, motor 50 and gearbox 48 is stablely over center and outward beyond the support structure 58, 64 whereupon the drive unit 38 is in an alternative disengaged position 38A shown in dotted lines. When the skewed lever 56 is turned up and over, it becomes acutely skewed to the cord 82 and the ring 84 slides to the inboard end of the lever to lessen the torque from the cord 82. The ring 84 is also snapped over center and the cord tends to stablely hold the drive unit 38 in the alternate position 38A.

The drive unit 38 is completely self tending and needs no further manual bias to frictionally engage the actuator wheel 30. The actuation switch 78 may be in the boat 18. The componentry of the lift drive 14 works interchangeably on either side of the boat lift 10 and in either the first or fourth quadrant. To move between quadrants, the drive unit 38 is reversed end for end on the subframe 40 and the unit mount is rotated about the post 22W and turned over along its length. The entire lift drive 14 fits upon almost every factory made boat lift of this general type. The usual 12 V DC battery power source poses no safety hazard, and can be easily fused with conventional boat fuses.

Devices such as this boat lift assembly are left unattended and are frequent targets for theft, and are usually removed from the water during winters, at last in the northern part of the country where the water freezes. The simple act of pulling the outer clip pin 70 releases the entire drive unit 38 and subframe 40 for removal from the lift assembly 10. This also enables usage of the drive unit 38 on other applications and machinery. If security is a concern, a paddlelock can be used in place of the outer clip 70.

The advantages of the invention are many as will be found in the years to come. The invention is economically viable and can be provided at reasonable cost and without concerns for serious hazards. The lift drive 14 can easily be removed from one lift per se 12 and installed upon another and different lift.

Although other advantages may be found and realized and various modifications may be suggested by those versed in the art, be it understood that I wish to embody within the scope of the patent warranted hereon, all such embodiments and equivalents as reasonably and properly come within the scope of my contribution to the art.

I claim as my invention:

1. An electrically powerable boat lift assembly, comprising (a) a mechanical boat lift having a fixed frame, a relatively movable boat lifting means movably mounted in said frame for lifting a boat in the lift up and out of the water, a drive movement interconnecting said frame to said lift means, and a lever for operating said drive movement;

(b) a tractive drive unit having a tractive frictional drive wheel, a DC electric motor, and a reduction drive connecting the motor to the drive wheel;

(c) mount means for movably mounting and supporting said drive unit on said frame with said drive wheel normally being in direct frictional engagement with and against said lever;

(d) self-operating biasing means for resiliently biasing said wheel directly against and into said frictional engagement with said lever;

(e) polarized connector means for both quick electrical connection and disconnection of said motor to a battery in the boat;

(f) electrical switch means connected to said connector means and to said motor for selectively running the motor in either direction, for selective raising and selective lowering the lifting means and the boat therein with the tractive drive motor being powerable by the boat battery.

2. The boat lift assembly of claim 1, in which said operating lever includes an actuator wheel, aid drive wheel being in frictional engagement with an outer diameter of said actuator wheel.

3. The boat lift assembly of claim 2, in which said drive wheel is located in an upper quadrant of said actuator wheel.

4. The boat lift assembly of claim 3, in which said mount means is positioned in said upper quadrant.

5. The boat lift assembly of claim 2, in which said mount means is outside of said lever outer ring.

6. The boat lift assembly of claim 1, including means for disengaging said lever, and support means for stablely supporting said drive wheel in an alternative disengaged position, enabling alternative manual operation of the lift assembly.

7. The boat lift assembly of claim 1, including means for moving said mount means up and down with respect to said lever.

8. In a boat lift assembly having a mechanical boat lift with a frame, movable lifting structure in the frame for support and lifting of a boat in the lift, a drive mechanism between the frame and the lifting structure, and a manually operable actuator wheel of at least two feet in diameter connected to the mechanism; the improvement of an electrical power boat lift actuator wheel drive comprising (a) a tractive drive unit having a tractive friction wheel, a DC motor, and a reduction drive connecting the motor to the friction wheel;

(b) a drive unit subframe having the drive unit mounted thereon and mount means for movable mounting of the subframe;

(c) a drive unit mount having securement structure fixedly fastened to said lift frame, subframe support structure secured to said mount means with said subframe and drive unit being mounted on and being relatively movable with respect to said support structure;

(d) self-operating biasing means at least partially on said subframe and drive unit for resiliently biasing said friction wheel directly against and in operative frictional engagement with actuator wheel;

(e) polarized electrical connector means connected to said motor for quick connection and disconnection of said motor to a battery in the boat; and (f) switch means connected to said motor and said polarized connector for selectively running said motor in either direction to selectively raise or lower the lifting structure and the boat with the motor being powerable by the boat battery.

9. The improvement of claim 8, in which said drive unit is rotatably mounted with respect to said subframe support structure, in which said friction wheel is in an upper quadrant about said support structure.

10. The improvement of claim 8, including means for adjusting the position of the subframe support structure within a quadrant of said actuator wheel.

11. The improvement of claim 8, in which said biasing means includes resilient structure for firstly mechanically forcing the friction wheel against the actuator wheel, and for alternatively holding the friction wheel stablely in an alternative disengaged position which is not in contact with the actuator wheel, for enabling optional manual operation of the boat lift assembly.

12. The improvement of claim 8, in which said drive unit, subframe, and subframe support structure are all positioned in an upper quadrant of said actuator wheel.

13. The improvement of claim 8, in which an included angle from the subframe support structure to a centerline of the friction wheel and thence to a centerline of the actuator wheel is an obtuse angle.

14. An electric boat lift drive for a mechanical boat lift having a frame, a lifting structure, a lifting mechanism between the frame and the lifting structure, and a manually operable actuator wheel of at least two feet in diameter, comprising:

(a) a tractive drive unit having a drive wheel, a DC motor, and a reduction drive connecting the motor to the drive wheel;

(b) a drive unit subframe having a mount securingly receptive of said drive unit, and means for movable suspension of the subframe and drive unit with respect to the frame and the actuator wheel;

(c) a drive unit mount having means for being secured to the lift frame, and support means for movably supporting and locating the subframe and drive unit;

(d) means for movably fastening the movable suspension means of the subframe to the support means;

(e) adjustment means in said unit mount for adjusting the relative positions of the subframe and the drive unit with respect to the actuator wheel;

(f) a quick connect polarized electrical connector means for connecting the motor to a battery in a boat; and (g) a normally off control switch having means connected to said polarized connector and to said motor for selectively running the motor in either direction of rotation under the power of the boat battery.

15. The boat lift drive of claim 14 in which said adjustment means has structure for providing adjustment of the position of the support means in both of an X and Y axis of the actuator wheel.

16. The boat lift drive of claim 14, in which the unit mount securing means includes a clamp structure securable to and adjustable along the length of a lift frame post, and in which said adjustment means includes a multiple position pilot and mount rod structure on said clamp for extending and adjusting the position of the support means transversely with respect to the lift frame post.

17. The boat lift drive of claim 14, including means on said subframe and said drive unit mount for enabling and limiting movement of the tractive drive unit to a stable alternative disengagement position wherein the drive wheel is stablely spaced from the lift actuator wheel, enabling optional manual actuation of the lift.

18. The boat lift drive of claim 14, including an elongate lever co-movable with and extending outward from said drive unit, a spring device for applying force to the elongate lever, and a slip connector for connecting the spring device to the lever for enabling an operative connection of the spring device to the elongate lever to slide back and forth along the length of the lever depending upon the position of the drive unit.

19. The boat lift of claim 14, in which said control switch is a positive center stop switch having an "up" connection on one side of the center stop, and a "down" connection on a second side of the center stop.

20. A method of electrically raising and lowering a boat in a boat lift, comprising the steps of (a) floating a boat with a battery therein into a boat lift;
(b) connecting the boat battery to a DC electric motor mounted on the lift;
(c) switching the motor on in a first direction of rotation and rotating a traction wheel in a corresponding first direction of rotation with power from the boat battery;
(d) biasing the traction wheel against an actuator wheel of the boat lift with structure operative between a frame of the lift and the traction wheel;
(e) frictionally driving the actuator wheel in a corresponding first direction to raise a movable portion of the boat lift and the boat up out of the water to a storage position;
(f) stopping the motor;
(g) switching the polarity of the electrical connection of the motor to the boat battery and running the motor in a second direction and similarly frictionally driving the actuator wheel in a corresponding second direction and lowering the movable portion of the lift and lowering the boat back into the water with power from the boat battery;
(h) disconnecting the motor from the boat battery; and
(i) removing the boat and battery from the lowered lift.

21. A method of converting any one of a variety of manual boat lifts into a boat battery powered boat lift, wherein the manual lift has a multiple post frame, lifting structure, a lifting drive mechanism, and a manual lifting actuator wheel of at least two feet in diameter and fixed in location with respect to at least one post of the frame, comprising the steps of (a) securing a drive unit mount to the frame, said mount having a drive unit support structure;
(b) adjusting the position of the drive unit mount with respect to the actuator wheel in a first co-ordinance direction by sliding the mount to a desired position on the frame and fixing the mount in this desired position;
(c) adjusting the position of the drive unit support structure with respect to the actuator wheel in a second co-ordinate direction by extending the support structure in a normal direction to the first co-ordinate direction to a desired position and fixing the support structure in the desired position;
(d) movably suspending an electric tractive drive unit on said positionally fixed support structure;
(e) biasing a tractive friction drive wheel of the drive unit resiliently against the actuator wheel with self-operating wheel biasing structure;
(f) quick connecting the drive unit to the battery in a boat to be lifted and then lowered, and providing DC power from the boat battery for selective operation of the drive unit in either a raising or lowering mode.

* * * * *